United States Patent [19]

Lamendour

[11] Patent Number: 4,460,291

[45] Date of Patent: Jul. 17, 1984

[54] TRACK FOR SOFT GROUND

[76] Inventor: André Lamendour, Le Passage, 29213 Plougastel Daoulas, France

[21] Appl. No.: 317,657

[22] Filed: Nov. 2, 1981

[30] Foreign Application Priority Data

Oct. 22, 1980 [FR] France ..... 80 22542

[51] Int. Cl.[3] ..... E01C 5/16; E01C 9/08

[52] U.S. Cl. ..... 404/35; 404/40; 14/2.4

[58] Field of Search ..... 404/35, 72, 36, 73, 404/37, 70, 40, 17; 14/2.4, 2.6, 27; 52/589

[56] References Cited

U.S. PATENT DOCUMENTS

| | | | |
|---|---|---|---|
| 407,422 | 7/1889 | Stewart | 14/27 |
| 1,325,575 | 12/1919 | Niewoehner | 404/35 X |
| 2,294,549 | 9/1942 | Greulich | 404/35 |
| 2,361,164 | 10/1944 | Arthur | 404/36 |
| 2,361,165 | 10/1944 | Arthur | 404/36 X |
| 2,384,395 | 9/1945 | Payne | 404/73 |
| 2,407,059 | 9/1946 | Crafton | 404/35 |
| 2,423,832 | 7/1947 | Gearow | 14/27 |
| 2,639,650 | 5/1953 | Robishaw | 404/35 |
| 2,987,024 | 6/1961 | Rush | 14/27 X |
| 3,134,116 | 5/1964 | Adkins | 14/2.6 |
| 3,999,879 | 12/1976 | Stachiw | 404/35 X |
| 4,277,201 | 7/1981 | Abell | 404/35 |

*Primary Examiner*—James A. Leppink
*Assistant Examiner*—Beverly E. Hjorth
*Attorney, Agent, or Firm*—Flynn, Thiel, Boutell & Tanis

[57] ABSTRACT

A reinforcing track for soft ground comprises two rows of pressed sheet metal rib members 1. The inner ends of corresponding rib members 1 in the two rows are articulated to connecting rods 5 near their lower, pointed edges. Longitudinal ties 2 and 8 and transverse ties 3 all of spring steel strip reinforce a plastics sheet covering 7 which together with the ties 2 and 3 are sandwiched between track plates 9 and flanges on the rib members 1. The track is flexible and can be reeled onto, and unreeled from a reel on a vehicle for recovery of and laying the track. The reel is carried by a frame supported on a turntable bearing on the vehicle chassis.

12 Claims, 9 Drawing Figures

TRACK FOR SOFT GROUND

FIELD OF THE INVENTION

The present invention relates to a metal and plastics track especially for forming roadways on soft ground (mud, snow, sand . . . ). This track is self-supporting.

BACKGROUND OF THE INVENTION

According to the present state of technology such tracks are constituted by thin panels which are laid and assembled together manually and they require lateral anchorages to the ground in the form of spikes.

Vehicle traffic over soft grounds so treated causes the fast formation of ruts resulting in breakage of the panels and thus interruption of traffic.

The present invention cures these drawbacks and has particularly for its object to propose a light and strong track, easy to lay manually or by mechanical means.

This object is achieved, according to the invention, in that this track comprises at least two rows of transverse metal stiffening ribs, disposed at regular intervals and attached to project from the underside of a reinforced plastic cover sheet.

Advantageously, the ribs are of substantially triangular cross section with an acute-angled peak.

Advantageously, the prismatic ribs are closed at each end and carry a peripheral edge or flange made of folded sheet metal around their bases, permitting the insertion of fixings for the other components.

Advantageously, all the ribs ends are linked together at regular interval through longitudinal steel ties, each row of ribs so forming a ladder.

Advantageously, the track comprises at least two rows of transverse metallic ribs. These rows are linked together by transverse spacers made of spring quality steel the two ends of which extend on both sides of the outward ends of the ribs.

Advantageously, the reinforced plastics covering disposed on the ribs extends beyond each of its sides so as to form a deformable lateral skirt.

Advantageously, the lateral extensions of the reinforced plastics cover sheet are sandwiched between the extensions of the transversal bars and a longitudinal tie acting on each side of the covering.

Advantageously, on the upper face of the covering are metallic or plastic non-skid runners, arranged according to a regular spacing, identical to that of the lower ribs.

Advantageously, the non-skid runners are fixed by rivets to the lower ribs, thus sandwiching the covering.

Advantageously, the inner ends of the ribs under the track are joined together by connecting rods articulated to them at their ends.

Advantageously, the vehicle track thus assembled presents the form of a band which can be rolled up on itself or on a core with its transverse ribs on the inner face.

Advantageously, the band of track described in this way can coil up on a coiling and uncoiling, pivoting and motorized frame, this permitting transport, laying down and recovery from a vehicle.

BRIEF DESCRIPTION OF THE DRAWINGS

Other characteristics and advantages of the invention can be understood better by reading the following description of an example of an embodiment, with reference to the annexed drawings in which.

DETAILED DESCRIPTION

Figure 1:
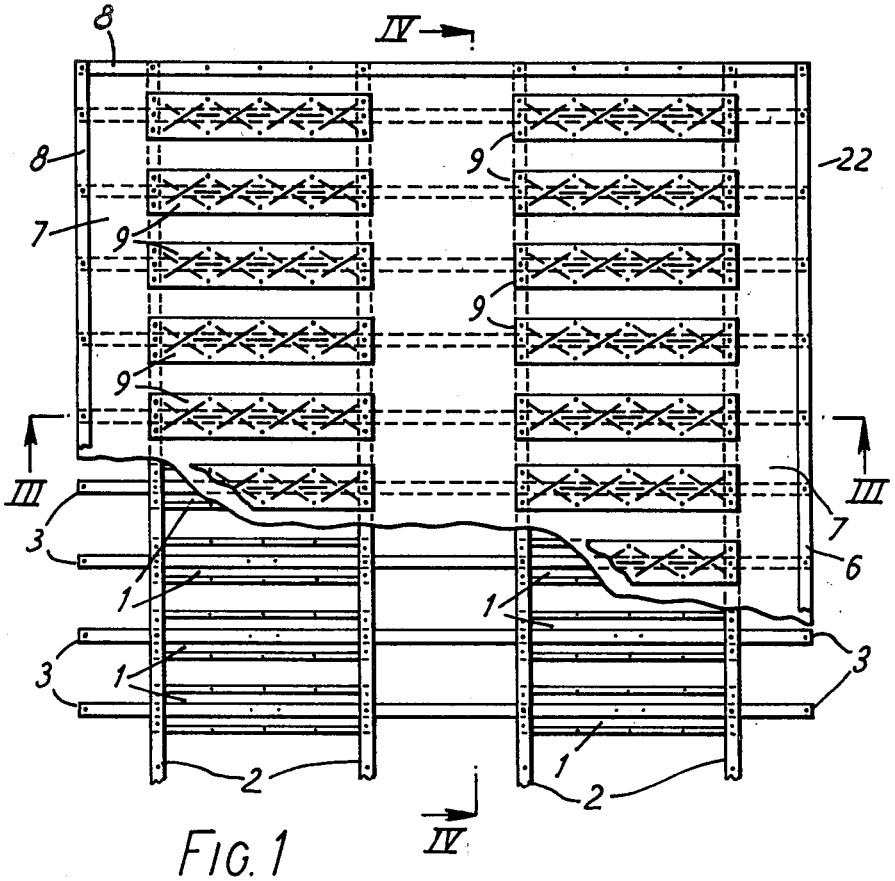
FIG. 1 is a view from above of the metal and plastics track according to one embodiment of the invention.
Figure 2:
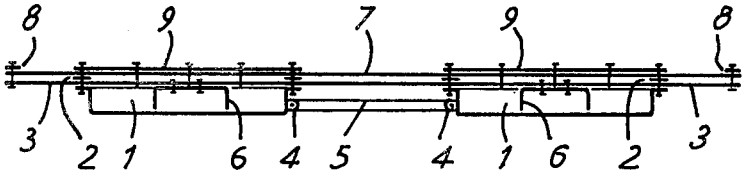
FIG. 2 is a vertical section following the line III—III transversely of the track.
Figure 3:
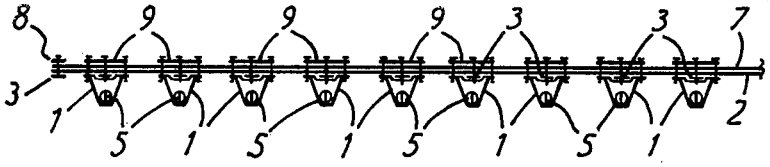
FIG. 3 is a vertical section following the line IV—IV longitudinally of the track.

The self-supporting metal and plastics track 22 represented in the FIGS. 1 to 4 is basically composed of at least two rows of metal ribs 1 assembled together at regular spacings, on the one hand in the longitudinal direction by steel spring ties 2, and on the other hand in the transversal direction by spring steel bars 3 extending beyond each side of the ends of the ribs. The rib members 1 are preferably sheet member pressings in the form of a V-sectioned trough.

Figure 4:
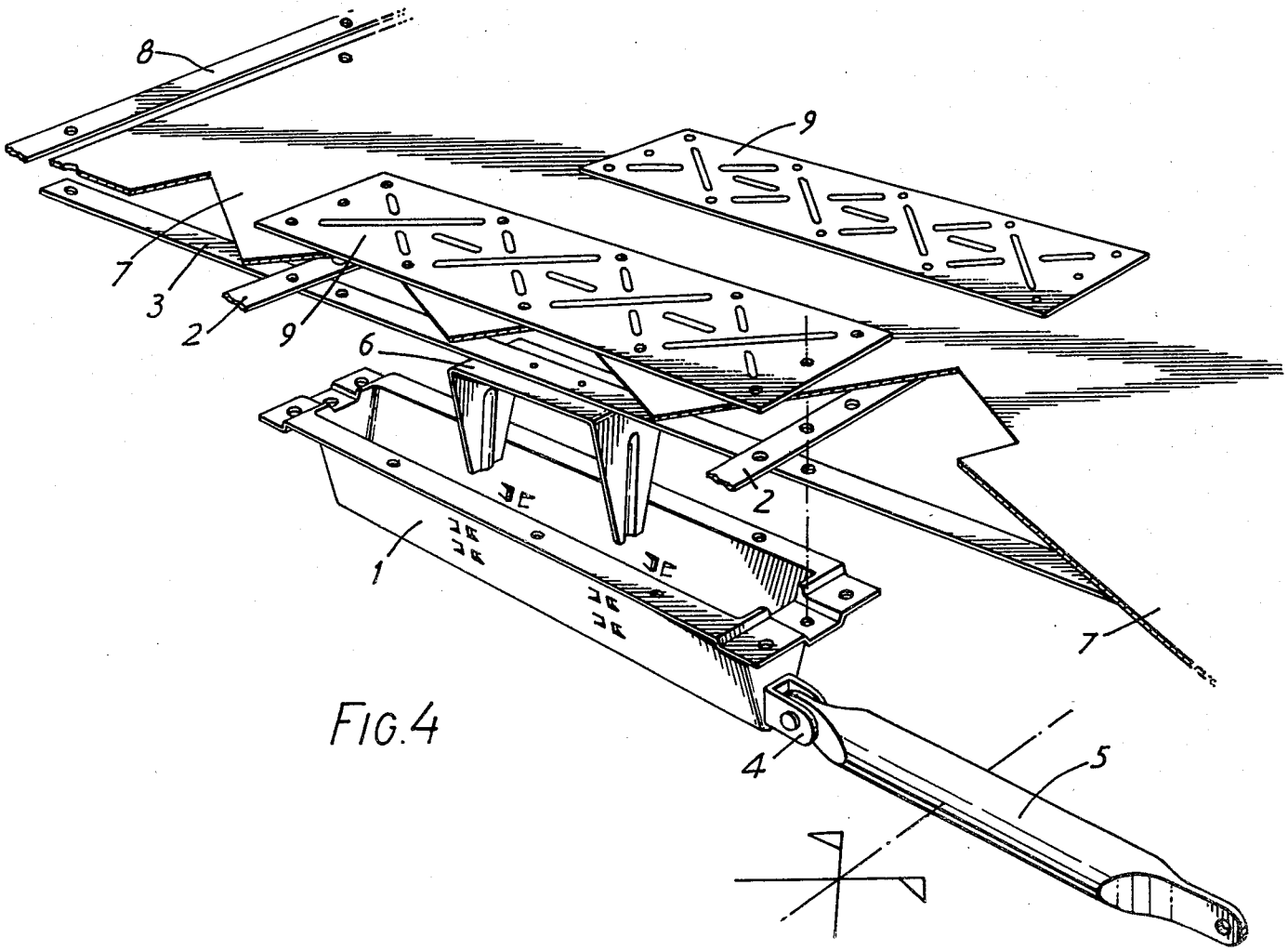
FIG. 4 shows an exploded view of a rib and of the components fixed to it.

The inner ends of the ribs 1 carry, at their base, a steel clevis 4 permitting the articulation of a small connecting rod 5. A strengthening stirrup 6 is included in each rib. The upper edge of each rib has, as shown in FIG. 4, out-turned flanges for receiving the fixing rivets.

The assembly parts 1-2-3-4-5-6 forms the carrying structure on which a flexble covering 7 is disposed which is a casing for the ground to be treated.

The mechanical connection between the covering 7 and the composite structure 1-2-3-4-5-6 is realised on the one hand, by the addition on to each side of the track, of longitudinal ties 8 placed on the upper side and fixed by rivets through the covering 7 to the ends of the bars 3, and on the other hand by the addition of metallic non-skid runners 9 composed for example of diamond-pointed projections, accurately superposed over the metallic ribs 1 to which they are fixed by means of the rivets passing through the covering 7.

To clarify FIGS. 1, 2 and 3, FIG. 4 represents an exploded view of the rib 1 in a non-limiting form of embodiment where the assembly arrangements of the various longitudinal and transversal components can be seen.

Figure 5:
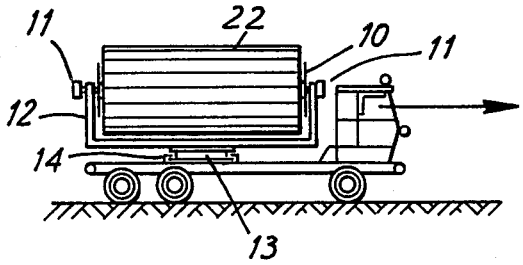
FIG. 5 is a diagrammatic view of the coiling, uncoiling, pivoting, motorized frame mounted on a vehicle, in its "transport" mode.

In FIG. 5 which represents a coiling, uncoiling, pivoting, motorized frame mounted on a track in a transport mode the track 22 can be seen coiled on a core 10 rotatable on bearings of the motor reducers 11, mounted on a pivoting stirrup 12 mounted on a turntable bearing 13.

This unit is fixed on to the chassis of the vehicle by means of a sliding saddle 14.

Figure 6:
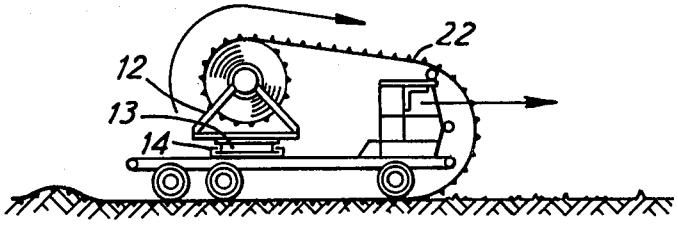
FIG. 6 is a diagrammatic view of the coiling, uncoiling, pivoting, motorized frame represented in the track uncoiling mode for laying in front of the carrier vehicle.

In FIG. 6, the track 22 uncoils towards the front of the layer vehicle. This possibility is obtained by the pivoting on the bearing 13 of the stirrup 12, perpendicular to the direction of the vehicle's movement.

Figure 7:
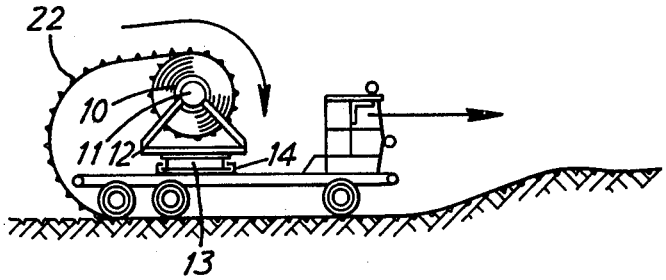
FIG. 7 is a diagrammatic view of the coiling, uncoiling, pivoting, motorized frame in a mode for recovery of track from behind the carrier vehicle.

In FIG. 7 the track 22 coils up from the back of the vehicle on to the core 10 which is driven by the motor reducers 11 to form a coil, at the same rate as the carrier truck moves on the track 22 during the course of recovery.

Figure 8:
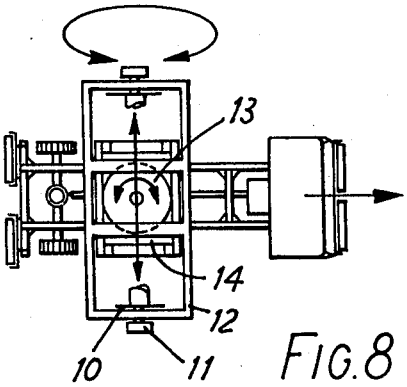
FIG. 8 shows diagrammatically the different movements and deplacements which are transmitted to the coiling, uncoiling, pivoting frame for proceeding, for example to the processes of laying or of removing the metal and plastics track.

In FIG. 8, the different movements and displacements which can be applied to the coiling, uncoiling, pivoting, motorized frame marked 10-11-12-13-14 and which allow the placing and recovery of track 22, are shown by arrows.

The motor reducers 11 apply a movement of rotation in one direction or the other, to the coiling core 10 of the track 22.

The turntable bearing 13 permits the pivoting of the stirrup 12 from 0° to 360° in relation to the direction of movement of the vehicle.

The sliding saddle 14 permits the correction towards the right or left, of the alignment of the pivoting stirrup 12 of the layer vehicle, with the axis of the track 22 to be laid or recovered.

Figure 9:
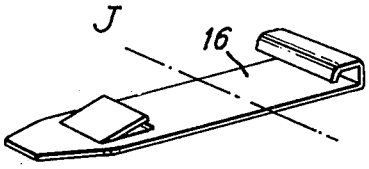
FIG. 9 represents one form of clip which permits the assembly of several bands of track.

In FIG. 9 is shown an example of steel clips which permit the assembly together of several bands of track. For the execution of an edge-to-edge linkage between adjacent tracks, the clips 16 are introduced beneath the lateral ties 8 between the consecutive ends of the bars 3. For execution of an end to end linkage, the clips 16 are introduced under the end bars 3 of the tracks to be linked.

I claim:

1. A track for use on soft ground comprising at least two sidewardly arranged rows of metal rib members disposed at regular intervals along the track, said rib members projecting from the underside of the track, said rib members being sheet metal pressings in the form of a V-sectioned trough, flanges surrounding the rib members, longitudinal and transverse ties secured to the rib members to maintain the rib members in their predetermined relative positions, individual track plates overlying and secured to the individual rib members, and a flexible covering sheet of plastics material fastened to the rib members, said covering sheet and said longitudinal and transverse ties being sandwiched between the track plates and said flanges surrounding the rib members.

2. A track according to claim 1, wherein the transverse and longitudinal ties comprise elongated strips of spring steel which are fixed to the flanges on the rib members so that the ties are positioned adjacent the upper ends of the rib members in close proximity to the flexible covering sheet, the metal rib members in the two adjacent rows being sidewardly spaced apart, and elongated rigid connecting rods extending between and being pivotally connected at their opposite ends to the inner ends of the corresponding rib members of said two adjacent rows, said connecting rods being pivotally connected to said rib members adjacent the lower ends thereof so that said connecting rods are spaced downwardly from the transverse ties.

3. A track according to claim 2, wherein said track plates are rigid metal plates which are individually secured to the individual rib members and are in predetermined spaced positions longitudinally of the track.

4. A track for use on soft ground comprising at least two sidewardly arranged rows of metal rib members disposed at regular intervals along the track, said rib members having flanges, said rib members projecting from the underside of the track, resiliently flexible longitudinal and transverse ties secured to the rib members to maintain the rib members in their predetermined relative positions, said ties comprising strips of spring steel, a flexible covering sheet of plastics material fastened to and overlying the rib members rigid connecting rods articulated at their ends to corresponding rib members of two adjacent rows, said covering sheet and said transverse ties extending laterally beyond the outermost edges of the rib members, and individual track plates overlying the individual rib members on the upper surface of the covering sheet, said covering sheet and the longitudinal and transverse ties being sandwiched between the track plates and said flanges.

5. A track for use on soft ground, comprising: an enlarged flexible covering sheet; a plurality of elongated rigid rib members secured to and projecting downwardly from the underside of said covering sheet, said rib members being of a converging cross section as they project downwardly to facilitate their penetration into the soft ground; said plurality of rib members being disposed within at least two transversely spaced rows which extend longitudinally of said track, the rib members of each row being spaced longitudinally at regular intervals and disposed so that the elongated direction of the rib members extends transversely of the track; a set of flexible longitudinal ties extending longitudinally of said track and being secured to said rib members for maintaining the rib members at said regular intervals; a set of transverse ties extending transversely of said track, each said transverse tie being secured to one of the rib members of one row and to a corresponding said rib member of the adjacent row, said transverse ties permitting transverse flexing of said track between said rows of rib members; and a plurality of rigid track plates positioned on the top side of said cover sheet and disposed within at least two transversely spaced rows which extend longitudinally of said track, said track plates being longitudinally spaced apart at regular intervals so that each said track plate is positioned directly above and is fixedly secured to one of said rib members.

6. A track according to claim 5, including a plurality of elongated rigid connecting rods positioned below said covering sheet and extending between and pivotally connecting the rib members of adjacent rows, each connecting rod having one end thereof pivotally connected to an inner end of a said rib member associated with one row, and the other end of said connecting rod being pivotally connected to the inner end of the corresponding rib member of the adjacent row.

7. A track according to claim 6, wherein said transverse ties comprise elongated metal spring strips which are positioned directly adjacent the underside of said covering sheet, said connecting rods being spaced downwardly from said transverse spring strips so as to be pivotally connected between the corresponding rib members at a location positioned adjacent the lower edge of the respective rib members, said transverse spring strips projecting outwardly in a cantilevered fashion beyond the outer ends of the rib members of said rows to define flexible side extensions, and said covering sheet extending sidewardly and overlapping these side extensions.

8. A track according to claim 7, wherein said longitudinal ties also comprise elongated metal spring strips, at least two said longitudinal spring strips being associated with and extending longitudinally along each row of rib members and being secured to the individual rib members for defining a ladder-like structure, and a further said longitudinal spring strip extending longitudinally along each free side edge of the covering sheet and being secured to the free ends of the transverse spring strips.

9. A track according to claim 8, wherein said rib members have flanges associated with the upper edge thereof, said flanges being disposed directly adjacent the under surface of said covering sheet and having said longitudinal end transverse spring strips secured thereto.

10. A track according to claim 5, wherein said transverse ties comprise elongated metal spring strips which are positioned directly adjacent the underside of said covering sheet, said transverse spring strips projecting outwardly in a cantilevered fashion beyond the outer ends of the rib members of said rows to define flexible side extensions, and said covering sheet extending sidewardly and overlapping these side extensions.

11. A track according to claim 5, including a vehicle for laying and recovering the track by unreeling and reeling the track respectively, said vehicle having a core mounted thereon for rotation about a substantially horizontal axis for permitting the track to be rolled therearound, and means supporting the core for movement about a substantially vertical axis to vary the position of the core for either reeling or unreeling.

12. A track according to claim 11, including means associated with the vehicle for permitting the core to be movably displaced sidewardly relative to the vehicle to selectively sidewardly displace the track relative to the vehicle.

* * * * *

UNITED STATES PATENT AND TRADEMARK OFFICE

CERTIFICATE OF CORRECTION

PATENT NO. : 4 460 291

DATED : July 17, 1984

INVENTOR(S) : Andre LAMENDOUR

It is certified that error appears in the above-identified patent and that said Letters Patent is hereby corrected as shown below:

Col. 4, line 8; after "members" insert a comma.

Signed and Sealed this

*Twenty-fifth* Day of *December 1984*

[SEAL]

*Attest:*

GERALD J. MOSSINGHOFF

*Attesting Officer*

*Commissioner of Patents and Trademarks*